US005363681A

United States Patent [19]

Speck et al.

[11] Patent Number: 5,363,681

[45] Date of Patent: Nov. 15, 1994

[54] APPARATUS FOR SHAPING WIRE

[75] Inventors: Norbert Speck, Reutlingen-Altenburg; Theodor Tröster, Reutlingen-Rommelsbach; Dietmar Sautter, Reutlingen-Betzingen, all of Germany

[73] Assignee: Wafios Machinenfabrik GmbH & Co., Reutlingen, Germany

[21] Appl. No.: 68,014

[22] Filed: May 27, 1993

[30] Foreign Application Priority Data

Sep. 2, 1992 [DE] Germany ..... 4229294

[51] Int. Cl.[5] ..... B21F 35/00

[52] U.S. Cl. ..... 72/129; 72/137; 72/145

[58] Field of Search ..... 72/135, 137, 129, 142, 72/145

[56] References Cited

U.S. PATENT DOCUMENTS

| | | | |
|---|---|---|---|
| 3,402,584 | 9/1968 | Cavagnero | 72/137 |
| 3,779,058 | 12/1973 | Norman | 72/145 |
| 3,802,241 | 4/1974 | Huhnen | 72/142 |
| 4,285,084 | 8/1981 | Brady et al. | 72/145 |
| 4,669,289 | 7/1987 | Itaya | 72/142 |
| 4,947,670 | 8/1990 | Wu | 72/137 |
| 5,105,641 | 4/1992 | Veit | 72/137 |

FOREIGN PATENT DOCUMENTS

| | | | |
|---|---|---|---|
| 2264589 | 9/1977 | Germany . | |
| 3915784 | 7/1990 | Germany . | |
| 0694478 | 7/1953 | United Kingdom | 72/142 |
| 2185921 | 8/1987 | United Kingdom | 72/137 |

*Primary Examiner*—Daniel C. Crane
*Attorney, Agent, or Firm*—Christa Hildebrand

[57] ABSTRACT

The invention relates to a wire shaping device. State of the art: DE 39 15 784 C1 discloses a wire shaping device comprising a program controlled rotating and displacing head which carries shaping tools and on to which moves the wire arriving from a stationary wire intake device. DE 22 64 589 C3 discloses, in the context of a spiral spring winding machine, a device for simultaneously taking in and twisting the incoming wire for producing an initial tension in the spring body. One disadvantage of the known wire shaping device is the relatively limited shapes of wire which can be produced. It is an object of this invention to improve the known wire shaping device for the purpose of increasing the range of finished shapes of the wire structures. The solution to this problem lies in a combination of the known twisting device with the known wire shaping device so that the wire intake device is rotatable about the axis of the wire and is program controlled, optionally also in its direction of feed (backwards as well as forwards). The advantage of this solution is the additional degree of freedom of the wire movement, which increases the shaping possibilities.

4 Claims, 3 Drawing Sheets

APPARATUS FOR SHAPING WIRE

FIELD OF THE INVENTION

The invention relates to an apparatus for shaping wire, in particular a spiral spring winding and bending machine, comprising a wire guide, a wire intake device arranged at the intake opening of the wire guide and nonrotatably clamping the wire, a shaft rotatably mounted at the outlet end of the wire guide and having its longitudinal axis of rotation situated close to the straight path of the wire outside the wire guide, a tool holder mounted to be rotationally fixed and optionally releasable at the free end of the shaft and carrying at least one tool for winding and/or bending the wire supplied thereto, the forward feed of the wire to the shaft by the wire intake device and the movements of rotation and displacement of the shaft for moving the tool into the path of the wire and relatively to the wire being program controlled, wherein at least the clamping parts of the wire intake device which clamp the wire which has been taken in can together be rotated selectively forwards or backwards about the axis of the wire guide in an intermittent manner related to the progress of the shaping operation, and in that the common movements of rotation of the clamping parts about the axis and optionally also a withdrawal of the wire away from the shaft by the wire intake device moving in reverse can be program controlled.

BACKGROUND OF THE INVENTION

In DE 39 15 784 C1 there is described a wire shaping apparatus which can be used for (limited) threedimensional bending of wire workpieces. In addition to the winding tools (88, 90) and bending tools (86, 142), it comprises another bending tool (92) in a rotating and displacing head forming a tool holder (74) which is replaceably inserted at the lower end of a spindle or shaft (12), for example of a CNC controlled spiral spring winding machine. This enables the bending and winding operations to be carried out directly at the nozzle of a special wire guide (50). This multifunctional tool (92) has four operating zones (108, 110, 112, 114) in two operating planes (IV 1 and IV 2), and each zone has two bending edges (108'; 108" and 114'; 114") so that bending can be carried out in all four spatial quadrants by superimposed longitudinal and rotational movements of the spindle (12).

For complicated wire parts, for example those having several bends and winding sections closely following one another, the multifunctional bending tool (92) is in many cases unable to be moved with its active bending edges to the bending point and put into operation there on account of lack of space, for example if the already partly formed workpiece stands in the way, with the result that this bending tool (92) is limited in its operational capacity so that the above-mentioned apparatus can only be used for producing relatively simple threedimensionally shaped wire parts.

SUMMARY OF THE INVENTION

It is therefore an object of the present invention to improve this known apparatus which in addition to supplying the wire executes three programme controlled movements (3-axial control) which are independent of one another and yet adapted to one another, so that as a result of the improvement even the most complicated threedimensionally bent and/or turned wire parts can be produced simply and with precision and yet relatively rapidly.

Proceeding from the knowledge that a turning of the supplied wire about its axis, which substantially increases the possibilities of wire shaping, constitutes an additional degree of freedom, the solution to this problem consists according to the invention in the apparatus.

According to the invention, therefore, an additional, fourth programme controlled movement (4-axial control) which is adapted to the previously provided CNC controlled movements is advantageously introduced. By this fourth movement, which is also CNC controlled, the wire which is fed from the supply coil is turned through a predetermined angle at a predetermined moment and optionally simultaneously with the feeding of the wire into the shaping station of the apparatus so that it is brought into the most suitable spatial position or operating position in relation to the shaping tools for each section of the shaping operation carried out on the workpiece to be produced, whereby dimensionally accurate and precision formed workpieces are obtained.

As further contribution to the state of the art, DE 22 64 589 C3 discloses a machine for winding spiral springs of spring wire in which the wire is continuously, i.e. during the entire winding process until the completed spring is cut off, twisted in one direction about its axis by means of the driven intake rollers in order to produce an initial tension in the wire before it moves on to the winding tools. For this purpose, the intake rollers (100) are mounted in a driven drum (107) which is rotatable about the axis of the wire (29). Although the present invention also makes use of the latter feature, the continuous twisting of wire in the known machine serves to produce spiral springs whose properties are improved by twisting and subsequent plastic deformation of the spring wire.

On the other hand, a computer controlled, predetermined, intermittent, selective forward and backward turning of the wire individually adjusted and adapted to the progress of the shaping process, as is provided by the present invention for producing wire workpieces which are threedimensionally shaped in all planes, is not provided in the known machine.

The invention will now be explained in detail with reference to the preferred embodiment of the machine according to the invention illustrated by way of example (and partly schematically) in the drawing, in which

DETAILED DESCRIPTION

The CNC controlled apparatus according to the invention, the constructional details of which are shown by way of example in FIGS. 1 to 4, consists mainly of a horizontal wire intake device 10, a wire shaping station 12 and a cutting tool 14 for cutting lengths of workpiece from the endless wire 16.

Figures 1, 2:
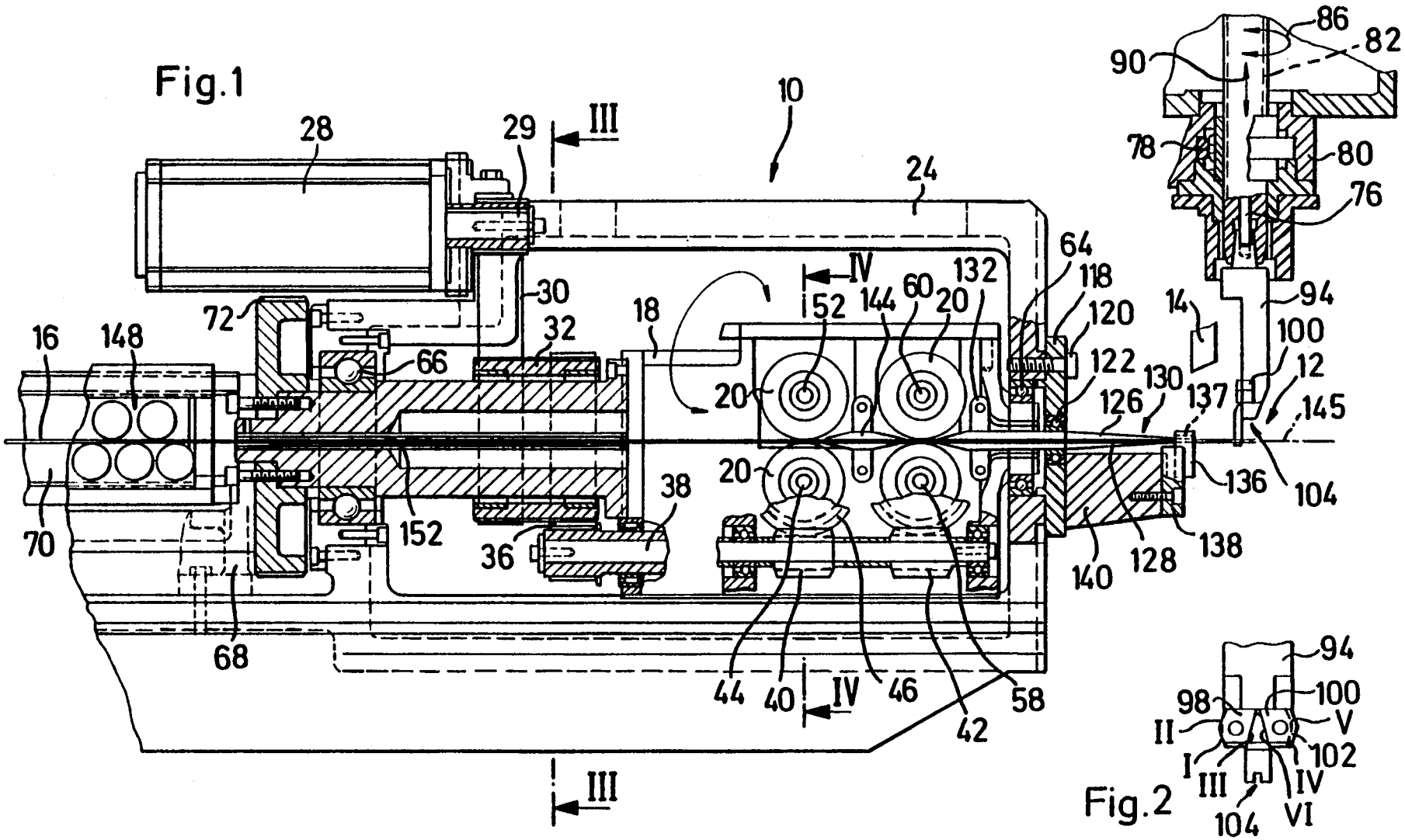
FIG. 1 is a front view of the embodiment partly broken away and in section.
FIG. 2 is a side view of a portion cut out of FIG. 1.
Figure 3:
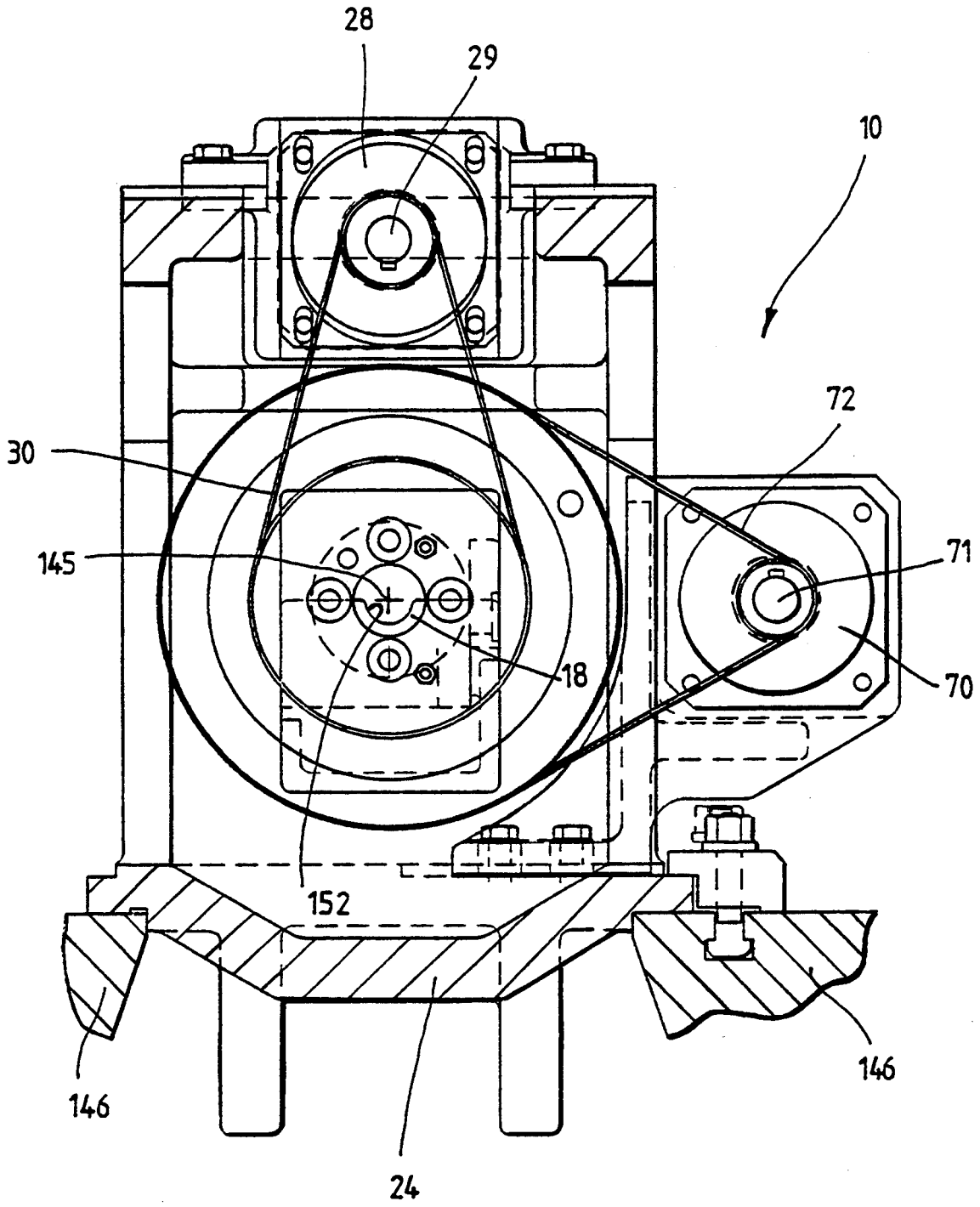
FIG. 3 is a section through the embodiment taken on the line III—III of FIG. 1
Figure 4:
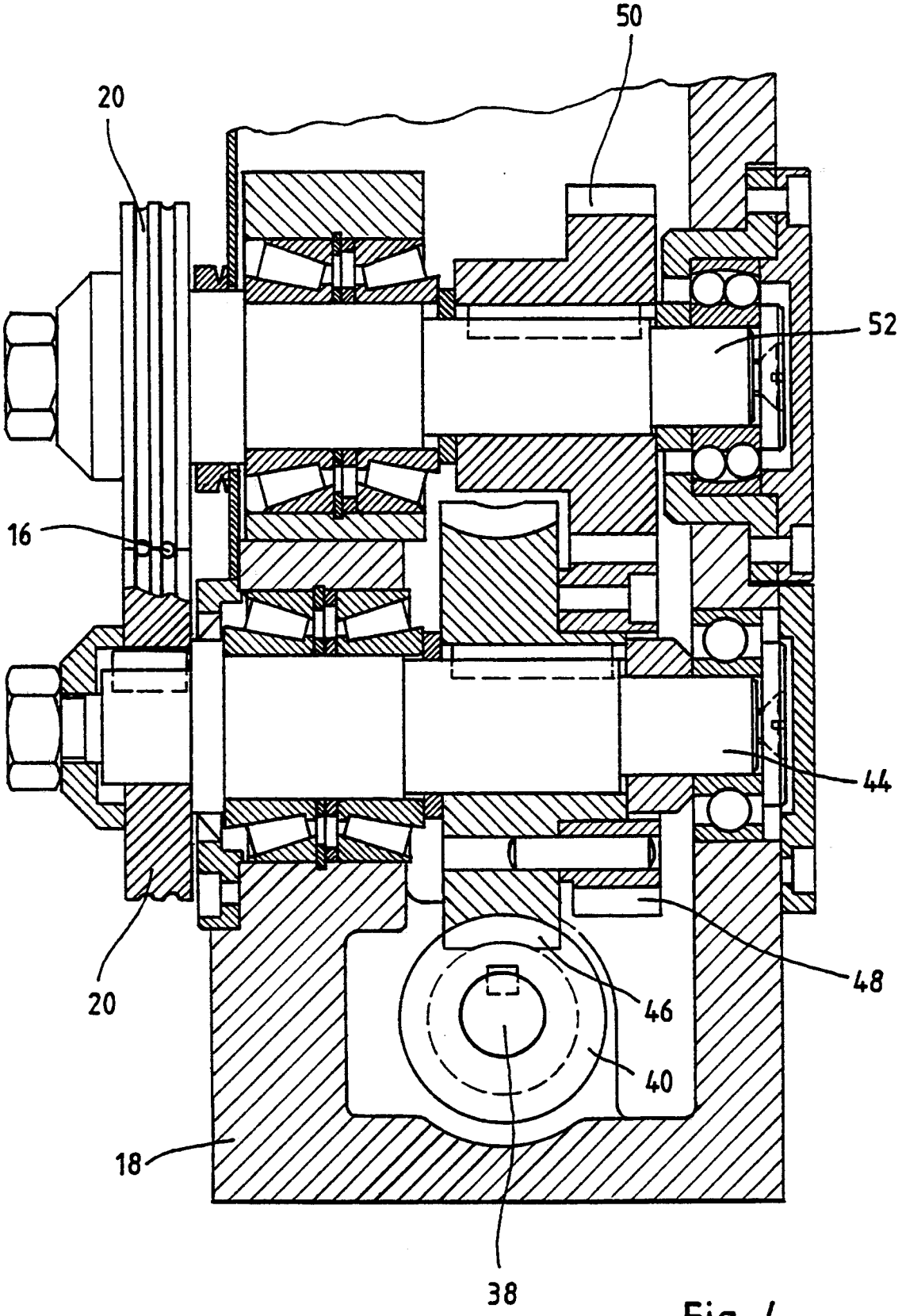
FIG. 4 is a section through the embodiment taken on the line IV—IV of FIG. 1.

The wire intake 10 comprises an intake housing 18 in which a total of four wire intake rollers 20 are rotatably mounted to push the wire 16 forwards into the wire shaping station 12. The rollers 20 are arranged pairwise and, programme controlled by a first CNC controlled servomotor 28 with shaft 29 on a bearing body 24 by way of a first toothed belt transmission 30, they are intermittently rotated selectively forwards and backwards at a controlled speed. For this purpose, an annular gear 32 which forms part of the first toothed belt transmission 30 is rotatably mounted on the intake housing 18 and forms part of a second toothed belt transmission 36 which drives a worm shaft 38 carrying two worms 40 and 42. A first worm 40 meshes with a worm wheel 46 which is fixed in its rotation on a lower drive shaft 44 of a first pair of intake rollers, and this worm 40 drives an upper drive shaft 52 at the same speed of rotation by way of gear wheels 48 and 50 while the second worm 42 similarly drives the drive shafts 58 and 60 of the second pair of intake rollers. The intake housing 18 is rotatably mounted in the bearing body 24 by means of ball bearings 64 and 66. The intake housing 18 is programme controlled by a second CNC controlled servomotor 70 with shaft 71 by way of a third toothed belt transmission 72 so as to be intermittently driven selectively forwards or in reverse, said servomotor 70 with shaft 71 being mounted on the bearing body 24 by bearings 68. The drive means of the intake rollers and of their housing cage 18 do not obstruct one another in these movements. In FIG. 1, a vertical shaft 76 situated to the right of the wire intake apparatus 10 is rotatably mounted in a spindle socket 80 perpendicularly to the direction of wire feed by means of a swivel bearing 78, as described in more detail in DE 39 15 784 C1. In the same way as described there, the shaft 76, which has gear teeth 82 distributed round its circumference over a large part of its length, is driven by a third CNC controlled servomotor 86 (only indicated) by way of a toothed belt drive (also not shown); the degree of spindle rotation, the sense of rotation and standstill can be freely selected.

In order that shaft 76 may in this case also be able to execute a longitudinal displacement in addition to its rotation, optionally simultaneously with said rotation, a fourth CNC controlled servomotor 90 (only indicated) is provided which drives a ball screw gear (not shown) by way of a toothed belt drive to convert the rotation of the servomotor 90 into a longitudinal displacement of the shaft 76. The amount of longitudinal displacement of the shaft 76 is also freely selectable by the CNC control.

A tool holder 94 known from DE 89 15 888 U1 is rigidly but detachably fixed in a conical holder at the lower end of the shaft 76. This tool holder may have a plurality of tools arranged round its circumference and distributed over its length. In the example illustrated (FIG. 2), the tool holder has two winding tools 98 and 100 which have several operating zones, each with a guide groove 102 for the wire 16 moving on to it, and a bending tool 104.

As shown in FIG. 1, a flange 118 is attached to the right end face of the bearing body 24 by screws 120. Seated in the centre of this flange 118 is a ball bearing 122 in which a two-part first wire guide 130 comprising an upper part 126 and a lower part 128 is rotatably mounted. This first wire guide 130, which is supported on the intake housing 18 in a first wire guide holder 132, extends to the left as far as the discharge end of the nip of the right hand pair of wire intake rollers and to the right it extends almost up to a wire guide attachment 136 which is screwed into a recess of a second wire guide holder 138 and cooperates with the cutting tool 14. The second wire guide holder 138 is detachably fixed in a groove which is directed towards the axis 145 of the first wire guide 130 and which is formed in a prismatic part 140 of the flange 118, this prismatic part extending in the direction towards the shaft 76. A wire guide bore 137 is worked into the attachment 136 in alignment with the axis of the first wire guide 130. To the left of the first wire guide 130, a second wire guide 144 is mounted on the intake housing 18 between the two pairs of intake rollers. The second wire guide 144 defines a straight wire guide axis 145 with the first wire guide. The bearing body 24 is displaceable on the machine frame 146 in the direction towards the shaft 76 so that the wire guides 130 and 144 and the attachment 136 can be adjusted to the workpiece to be produced.

A conventional wire straightening device 148 with horizontally and vertically arranged straightening rollers is arranged at the left or wire intake side of the rotatably mounted intake housing 18, as shown in FIG. 1, to straighten the wire 16 before it is passed through a hollow shaft 152 forming part of the intake housing 18 to be introduced between the intake rollers 20.

The mode of operation of the apparatus according to the invention is as follows:

When the first servomotor 28 is activated, the straightened endless wire 16 which is stretched between the intake rollers 20 is intermittently moved forwards horizontally in a straight line through the wire guides 130 and 144 and the attachment 136 by means of the CNC controlled intake rollers 20 to enter the wire shaping station 12 where it is shaped according to the tools which become active on the tool holder 94. CNC controlled withdrawal of the wire is also possible by reversal of the sense of rotation of the motor.

Bringing the individual tools into position before the shaping process and the active movement of the tools for the shaping of the workpiece are brought about by CNC activation of the third and fourth servomotors 86 and 90, as known from the exemplary DE 39 15 784 C1.

The endless wire 16, delivered by the intake rollers 20 and CNC controlled by the second servomotor 70 by way of the toothed belt transmission 72 and the intake housing 18, is turned through a predetermined angle and at the right moment, optionally simultaneously with the feed movement of the wire 16, into the most suitable position in space for carrying out the next operating step, if necessary for each individual section of the wire shaping operation, taking into account the recoil of the resulting wire structure. Each previously formed section will, of course, participate to the same extent in the turning movement in subsequent operating steps; thus, for example, when the wire workpiece has been shaped, it may be turned so that it can be gripped and taken over by a gripping tool in the most suitable position before it is severed from the incoming wire by a knife of the cutting device 14, for example up against the wire guide attachment 136, in order to be transported by the gripping tool into a subsequent operating station.

Before the onset of production of the next workpiece to be shaped, the second servomotor 70 turns the intake housing 18 back into its starting position so that the portion of wire which is fed from the wire supply, for example an overhead reel, and is now situated in front of the wire straightening device 148 will not be plastically twisted. This cannot take place during shaping because the following length of wire is then only twisted in accordance with the balance of forward and backward rotations of the section of wire which has been drawn in.

We claim:

1. An apparatus for shaping wire, in particular a spiral spring winding and bending machine, comprising a wire guide, a wire intake device having clamping parts arranged at the intake opening of said wire guide and non-rotatably clamping the wire, a shaft rotatably mounted at the outlet end of the wire guide and having its longitudinal axis of rotation situated close to the straight path of the wire outside the wire guide, a tool holder mounted to be rotationally fixed at the free end of the shaft and carrying at least one tool for winding and/or bending the wire supplied thereto, the forward feed of the wire to the shaft by the wire intake device and the movements of rotation and displacement of the shaft for moving the tool into the path of the wire and relatively to the wire being program controlled, whereby at least the clamping parts of the wire intake device which clamp the wire which has been taken in can together be rotated selectively in either direction of rotation about the axis of the wire guide in an intermittent manner related to the progress of the shaping operation, and in that the common movements of rotation of the said clamping parts about the axis can be program controlled and further, wherein the wire intake device has at least one pair of cooperating rollers provided with at least one driving shaft mounted on a housing which is rotatable about the axis of the wire guide and on which a main shaft which is parallel to the axis is rotatably mounted and acts on the roller-driving shaft by way of a gear wheel transmission, and wherein the gear wheel transmission comprises a worm gear whose main shaft is a worm shaft which is situated outside the axis of the wire guide and which is adapted to be driven by an annular gear by way of a toothed belt transmission, which annular gear is arranged coaxially with the wire guide axis.

2. The apparatus according to claim 1, wherein the annular gear is seated freely rotatably on the hollow shaft and forms part of a toothed belt transmission which is acted upon by a motor shaft having its axis parallel to said hollow shaft.

3. The apparatus according to claim 2, further comprising a wire straightening device, wherein the wire straightening device is attached to that end of the hollow shaft which is remote from the housing.

4. An apparatus for shaping wire, in particular a spiral spring winding and bending machine, comprising a wire guide, a wire intake device arranged at the intake opening of said wire guide and nonrotatably clamping the wire, a shaft rotatably mounted at the outlet end of the wire guide and having its longitudinal axis of rotation situated close to the straight path of the wire outside the wire guide, a tool holder mounted to be rotationally fixed at the free end of the shaft and carrying at least one tool for winding and/or bending the wire supplied thereto, the forward feed of the wire to the shaft by the wire intake device and the movements of rotation and displacement of the shaft for moving the tool into the path of the wire and relatively to the wire being program controlled, whereby at least the clamping parts of the wire intake device which clamp the wire which has been taken in can together by rotated selectively in one or the other of the two opposite directions of rotation about the axis of the wire guide in an intermittent manner related to the progress of the shaping operation, and in that the common movements of rotation of the said clamping parts about the axis can be program controlled, and wherein the wire guide is provided with a wire guide attached which is seated in a wire guide holder and arranged between the outlet end of said wire guide and the shaft, said wire guide holder is mounted perpendicularly to the wire guide axis on a prismatic part extending in the direction towards the shaft, and wherein the attachment cooperates with a cutting tool which severs the wire at the attachment.

* * * * *